United States Patent [19]

Beveridge

[11] 3,980,829

[45]*Sept. 14, 1976

[54] WIDE ANGLE CYLINDRICAL WAVE LOUDSPEAKER EXTENDING APPROXIMATELY FROM FLOOR TO CEILING HEIGHT WITH A LENS

[76] Inventor: Harold Norman Beveridge, 1616 Franceschi Road, Santa Barbara, Calif. 93103

[ * ] Notice: The portion of the term of this patent subsequent to June 6, 1989, has been disclaimed.

[22] Filed: June 5, 1973

[21] Appl. No.: 367,157

[52] U.S. Cl. ..... 179/1 GA; 179/1 E; 181/176

[51] Int. Cl.[2] ..... H04R 5/02; H04R 1/34

[58] Field of Search ..... 179/1 E, 1 G, 1 GA; 181/175–197; 116/142 R

[56] References Cited

UNITED STATES PATENTS

| | | | |
|---|---|---|---|
| 1,735,860 | 11/1929 | Hutchison | 181/144 |
| 1,849,486 | 3/1932 | Haigis | 181/31 A |
| 2,102,212 | 12/1937 | Olson | 181/31 A |
| 2,143,175 | 1/1939 | Waite | 179/1 E |
| 2,481,576 | 9/1949 | De Boer | 179/1 G |
| 2,537,141 | 1/1951 | Klipsch | 181/191 |
| 2,636,943 | 4/1953 | Schaeffer | 179/1 G |
| 2,751,996 | 6/1956 | Levy | 181/187 |
| 2,820,525 | 1/1958 | Fountain et al. | 181/195 |
| 2,941,044 | 6/1960 | Volkmann | 179/1 G |
| 3,027,964 | 4/1962 | Spragins, Jr. et al. | 181/176 |
| 3,070,669 | 12/1962 | Franssen et al. | 179/1 G |
| 3,162,727 | 12/1964 | Schjonneberg | 179/1 G |
| 3,179,202 | 4/1965 | Cole et al. | 181/147 |
| 3,207,257 | 9/1965 | Wilson | 181/147 |
| 3,303,904 | 2/1967 | Kelly | 181/176 |
| 3,308,237 | 3/1967 | Novak | 179/1 E |
| 3,389,226 | 6/1968 | Peabody | 179/111 R |
| 3,582,553 | 6/1971 | Bose | 181/31 B |
| 3,668,335 | 6/1972 | Beveridge | 179/111 R |

FOREIGN PATENTS OR APPLICATIONS

| | | | |
|---|---|---|---|
| 1,199,441 | 6/1959 | France | 179/1 GA |
| 604,080 | 4/1960 | Italy | 179/1 GA |
| 978,781 | 12/1964 | United Kingdom | 179/1 GA |
| 829,214 | 3/1960 | United Kingdom | 181/31 B |

OTHER PUBLICATIONS

*Audio*, Nov. 1960, pp. 20, 21, 78, 77, 79 & 80.

Column Loudspeaker Systems by George Augspurger, Electronics World, June 1963.

Sound Reinforcement for Banquet Halls, Ballrooms and Conference Rooms by Horn et al., Journal AES, vol. 17, No. 2, Apr. 1969, pp. 156–164.

*Primary Examiner*—George G. Stellar

[57] ABSTRACT

Loudspeaker and stereophonic system employing hemicylindrical wave form generators, in which the vertical extent of the speaker includes and spans the levels of seated and erect standing listeners, approximating a floor to ceiling height. Two such speakers are placed in a room, directed toward each other and spaced from an end wall, with arc of sound emission of each such that the listener region receives direct sound and two first order reflections, from side and end walls, from each of the two speakers. The path lengths are shown different in length greater than the minimum separate-source discrimination time.

6 Claims, 11 Drawing Figures

FIG 3a
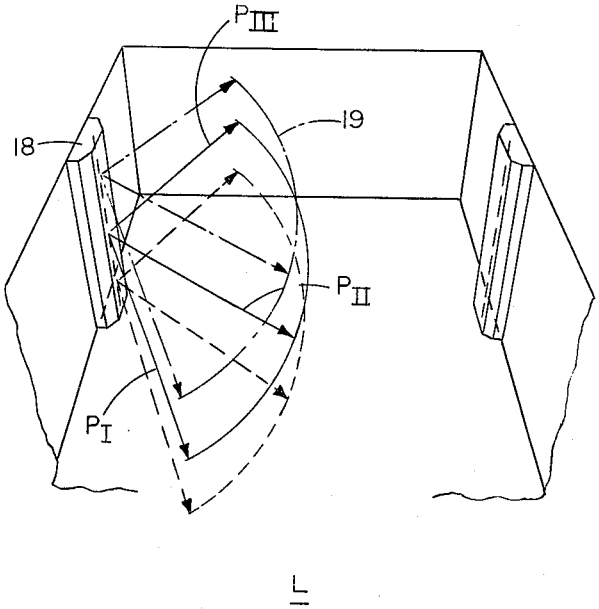
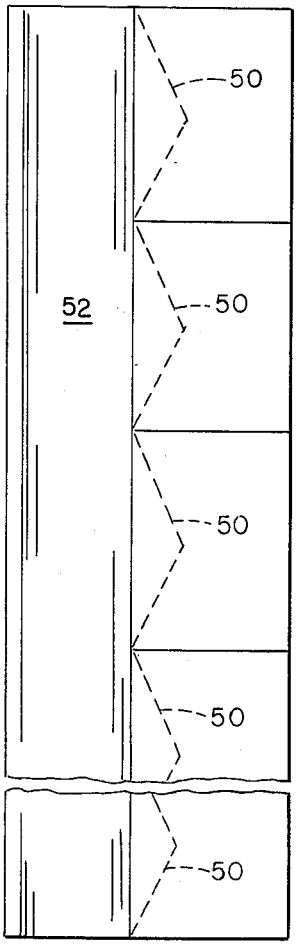
FIG 7
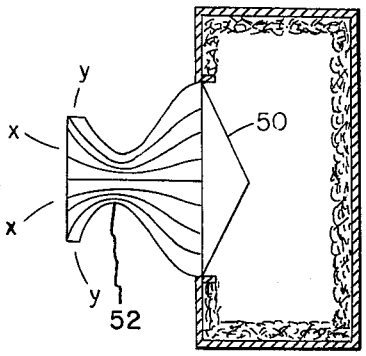
FIG 8

FIG 5
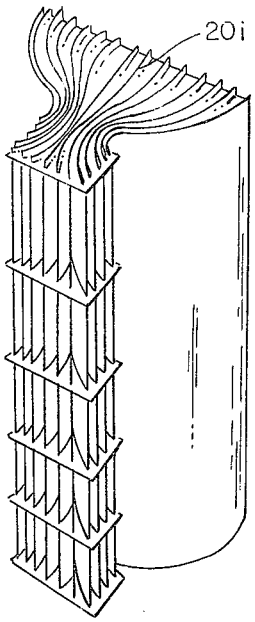
FIG 6
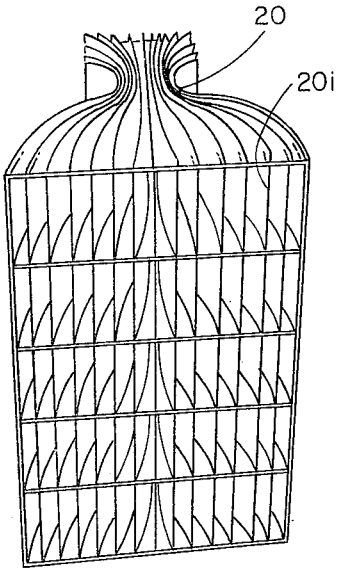
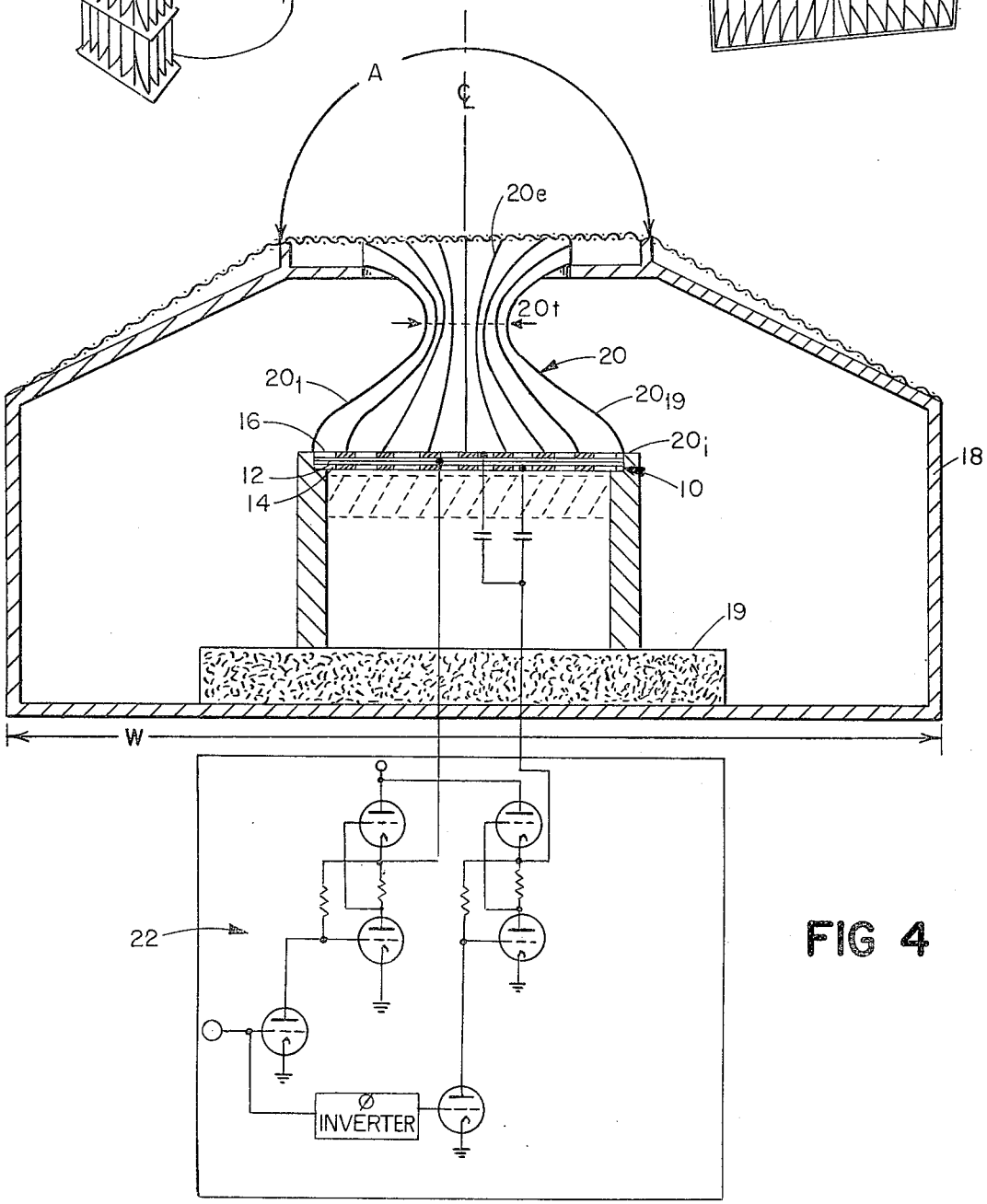
FIG 4

WIDE ANGLE CYLINDRICAL WAVE LOUDSPEAKER EXTENDING APPROXIMATELY FROM FLOOR TO CEILING HEIGHT WITH A LENS

This invention relates to high fidelity loudspeaker systems useful in the home.

The principal object of the invention is to provide means for achieving a high fidelity, transparent sound sensation in rooms of a home, including small rooms and rooms having low ceilings.

According to one aspect of the invention, a loudspeaker is provided which includes a loudspeaker of the cylindrical wave generator type having a vertical axis, a generally hemicylindrical sound emitting arc, preferably at least of about 150° extent, and a vertically elongated sound-emitting extent approximating in effect a floor to ceiling height, including and spanning the elevations of normal seated and standing listener positions, the positions of ½ and 1 ¾ meters above the floor. Preferably the loudspeaker includes a lens having a series of channels leading from the sound source to the speaker outlet, the channels including substantially straight mid-channels and gradually curving and diverging outer channels and preferably the sound source is a full-range electrostatic speaker.

According to another aspect of the invention, the above loudspeaker is incorporated into a speaker system including two vertical sound-reflective surfaces spaced from the speaker and from the listener region, the speaker being constructed and positioned to emit sound directly along a first path toward the listener region and toward each of the reflective surfaces; the reflective surfaces are positioned and adapted to reflect a full-height sound image of the speaker to the listener region along respective second and third paths, with the first, second and third paths preferably differing in length from each other at least by the distance equivalent to the minimum separate-source discrimination time, preferably the paths varying from each other by at least about a meter. Preferably the above system is constructed for stereophonic sound, with two speakers each mated with a pair of the reflective surfaces and preferably, in a home, the reflective surfaces are formed by a room having an end wall and left and right side walls, left and right loudspeakers positioned along respective side walls, each spaced from the end wall and the loudspeakers directed toward each other, the arc of radiation of each of the speakers including the listener region, the opposite side wall and the end wall, the second path for each speaker extending to the opposite side wall thence to the listener and the third path for each speaker extending to the end wall thence to the listener region, preferably the loudspeakers being spaced at least about a meter from the end wall.

These and other features and advantages of the invention will be understood from the following description of a preferred embodiment, in conjunction with the drawings wherein:

FIG. 1 is a diagrammatic side view illustrating one feature of the invention while

Figure 4A:
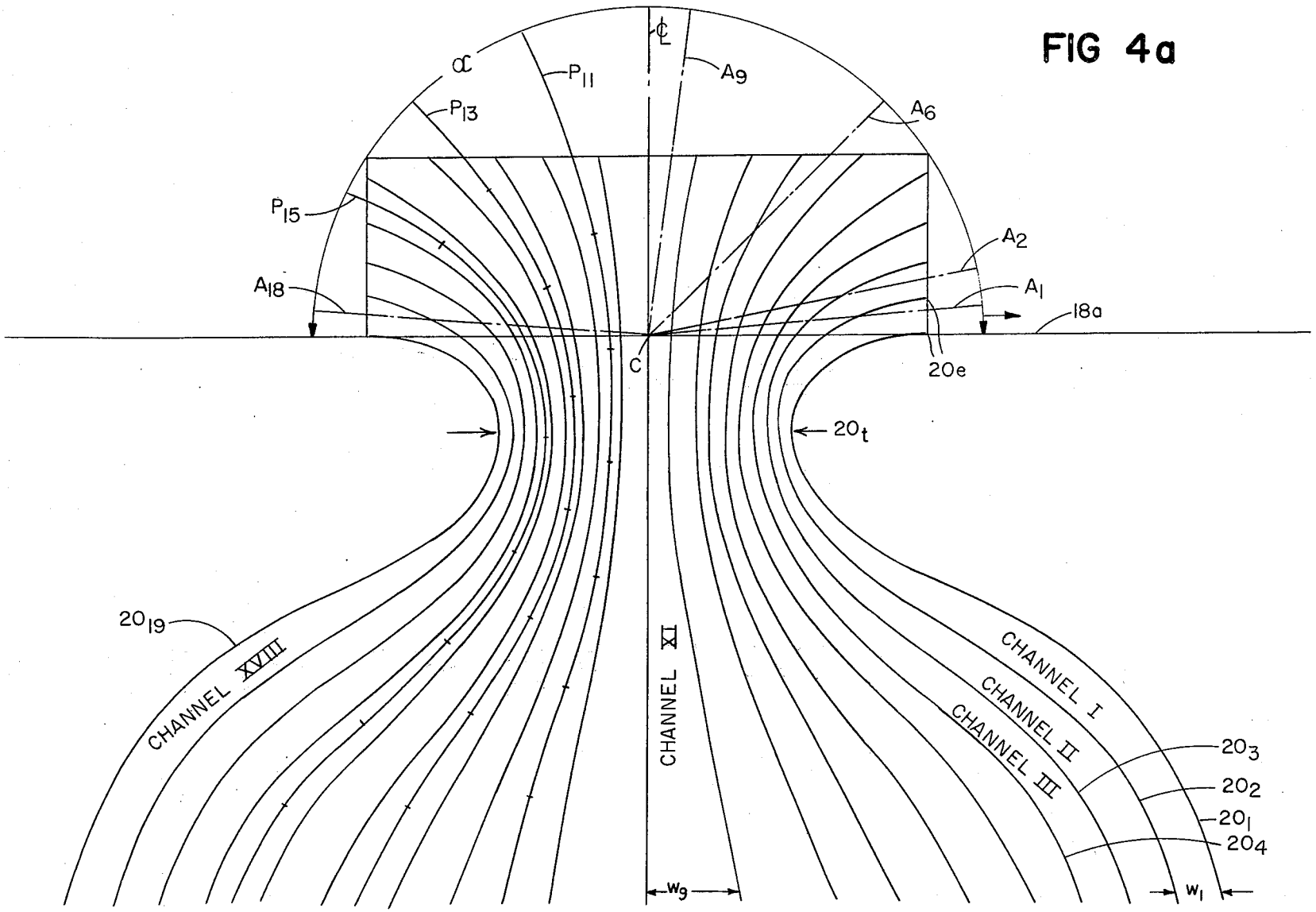
FIG. 4 is a horizontal cross-sectional view of a full audio range electrostatic speaker according to the invention, including schematically an amplifier system.

FIG. 4*a* shows in greater detail the configuration of the lens walls for the loudspeaker of FIG. 4;

FIG. 5 is a prespective view of the front portion of the lens system of FIGS. 4 and 4*a*, showing the outlet;

FIG. 6 is a perspective view similar to FIG. 5 viewed from the back to reveal the inlet of the lens system; and FIG. 7 is a side view and FIG. 8 is a plan view of an alternative embodiment of a speaker for use according to certain aspects of the invention.

Figure 1:
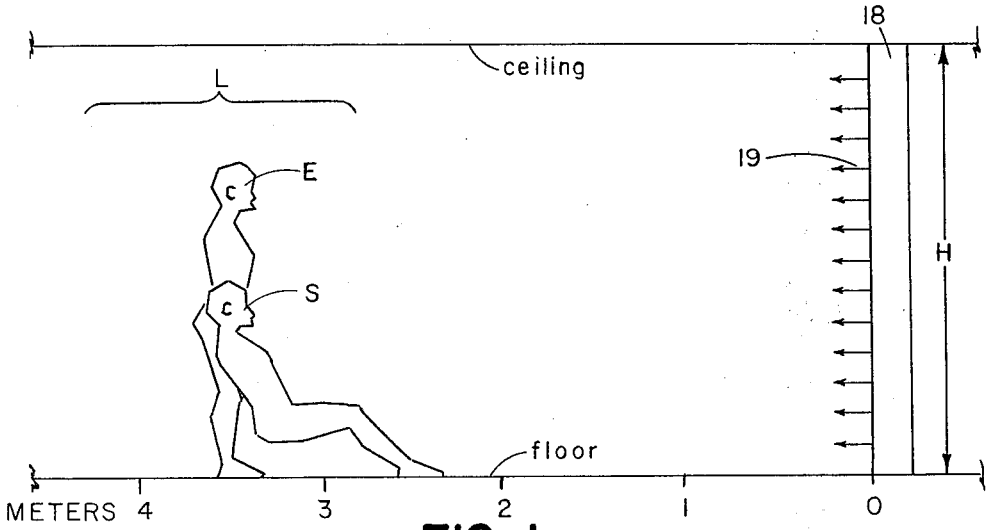

Referring to FIGS. 1 and 3*a*, a vertical axis, cylindrical wave generator-type loudspeaker 18 generates a hemi-cylindrical wave 19 of all frequencies of interest, base and treble, which uniformly illuminates the listener region L with all frequencies. In this drawing the speaker is shown to extend entirely from floor to ceiling, thus having an extent which spans and extends beyond the normal listener sitting position S and erect position E. As denoted by the arrows, the direct sound pressure field at all frequencies is uniform throughout the height of the speaker, hence the listener will observe the same sound sensation regardless of a change in his elevation. Also, due to this arrangement, the ceiling and floor form boundaries of the cylindrical wave and no pattern of ceiling or floor reflections is produced which can create destructive interference patterns of the sound reaching the listener.

Figure 2:
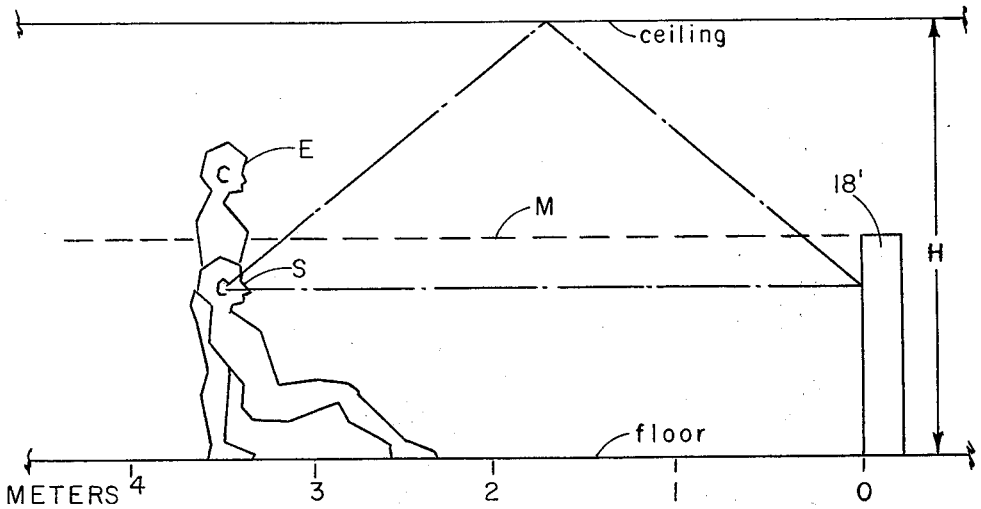
FIG. 2 is a similar view of an arrangement omitting the feature of FIG. 1 and FIG. 2*a* graphs interferences experienced with the construction of FIG. 2.

For contrast, a different arrangement is shown in FIG. 2. Speaker 18' is a cylindrical wave generator but has only a height of about a meter from the floor. Two serious problems arise. The direct high frequency sound, very directional, as well as the direct lower frequency sound, illuminate the seated listener S as in FIG. 1. But, since the height of the erect standing listener E is above the level M of the speaker 18', the same intensity of high frequency (and highly directional) sound does not reach position E; the sound field is distorted.

Figure 2A:
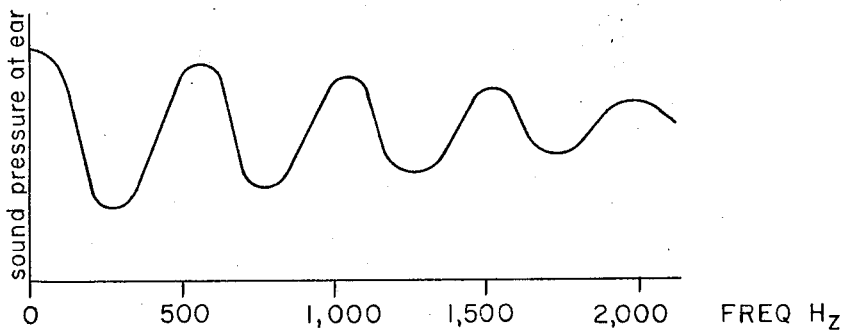

Furthermore, as the top of the speaker 18' is well below the ceiling, the speaker behaves much like a point source in respect of low frequency sound, and a significant ceiling reflection results. This ceiling reflection also represents a distorted field, omitting the important higher frequencies. Furthermore, the room depicted may have a low ceiling height as is common in homes, e.g. 2 ½ meters or considerably less. Accordingly, the path length of the reflection may be quite close in length to the direct path length, resulting in interference with the direct radiation at the lower frequencies, as represented in FIG. 2*a*.

The over-all result is that the listener in the erect position hears a dull, uninteresting sound, lacking in the quality known as transparency and the listener encounters annoying variation in the sound as he moves between the two elevations.

Desirable effects of the invention described in connection with FIG. 1 are obtained even when the speaker does not entirely reach the floor or ceiling, albeit with some loss as the variation from the ideal floor-to-ceiling relationship occurs. However, the height should approximate the floor-to-ceiling relationship, spanning between and extending beyond the normal seated and standing positions, generally including points ½ meters and 1 ¾ meters above the floor (and, preferably, 2 m. point).

Figure 3:
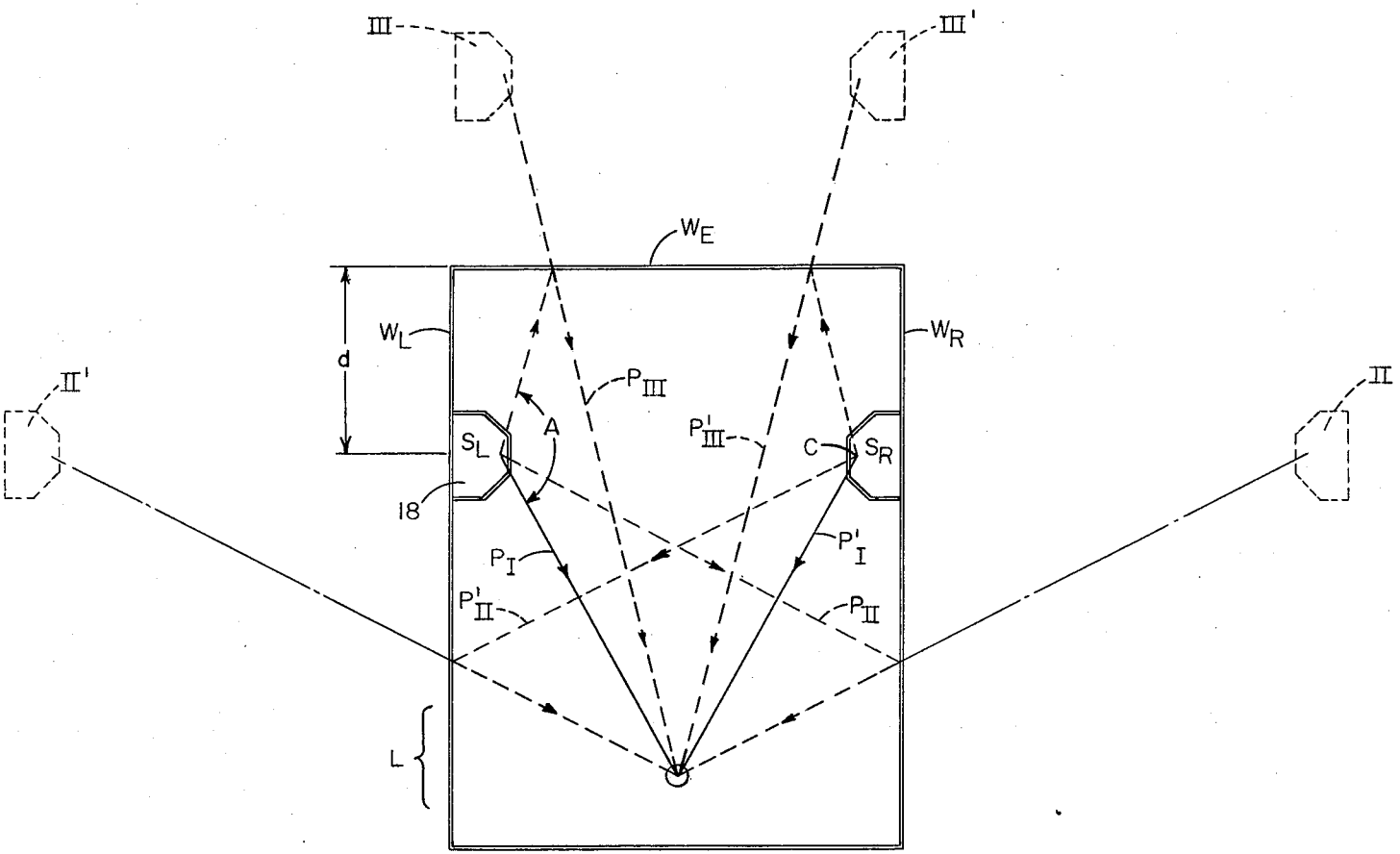
FIG. 3 is a diagrammatic plan view and FIG. 3*a* a perspective view of a stereophonic loudspeaker arrangement according to the invention.

Referring to FIGS. 3 and 3*a*, the speaker 18 of FIG. 1 is disposed in the special relationship whereby the cylindrical sound wave from speaker 18 directly reaches the listener region L along path $P_I$, and also reaches that region along paths $P_{II}$ and $P_{III}$, each comprising a first order reflection off of a vertical sound-reflective wall, and the geometry being such that the differences between the lengths of these various paths is greater than the separate source discrimination time. (This time refers to the psycho-acoustic observation that humans treat similar pairs of sounds differently dependent upon length of time between the sounds. For short time intervals two sounds are merged into one sound sensation. This phenomenon may be related to the way humans are able to deal with a single sound despite the difference in time at which it reaches the different ears. When the time between the sounds is considerably longer, e.g. greater than 2 milliseconds, the listener can detect two different sources and directions, with increasing precision as the length of time increases. Preferably therefore the differences between the various paths is at least ½ meter and preferably at least 1 meter. Such distances assure the detection of virtual sound images II and III from the two reflective surfaces.)

With further reference to FIGS. 3 and 3*a*, these reflective surfaces are formed by the walls of a room in which two speakers are arranged to produce stereophonic sound.

The room comprises end wall $W_E$ and left and right side walls $W_L$ and $W_R$. The speaker 18 referred to above is the left speaker, $S_L$, disposed along the left wall and the right speaker, $S_R$, is disposed along the right wall.

The paths of the left speaker, $P_I$, $P_{II}$, and $P_{III}$ are direct, 1st reflection from right wall $W_R$ and 1st reflection from the end wall $W_E$. Similarly the paths of the right speaker, $P_I'$, $P_{II}'$, and $P_{III}'$ are respectively direct, 1st reflection from left wall $W_L$ and 1st reflection from the end wall $W_E$.

It will be noted that the arc of the cylindrical wave front emitted by each of the speakers is sufficiently wide to direct sound directly to the listener and against the end wall at an angle to reach the listener by 1st reflection and suitably delayed as noted above.

In the preferred form for accomplishing this, shown in FIG. 3, the speakers have arcs of radiation greater than 150° included angle A between paths $P_I$ and $P_{III}$, and the speakers are spaced away from the end walls distance *d*, preferably a distance of at least about a meter.

The effect of this arrangement is to present to the listener six different sound waves, all covering the entire frequency range, and coming apparently from six different sources, the two actual speakers and the first reflection virtual images II, II', III and III'.

At the same time, the listener is not confronted with distorted fields due to interference or part but not all of the frequencies reaching the listener in a given image.

The net result is a distinct impression of a highly transparent and broad sound source. By virtue of the floor to ceiling hemi-cylindrical form of the wave fronts, attenuation occurs more nearly on the basis of 1/R where R is the path length, rather than $1/R^2$, giving a more uniform field intensity in the listener region.

In this preferred embodiment the speakers are constructed in accordance with my U.S. Pat. No. 3,668,335 to which reference is made.

Referring to FIGS. 4, 4*a*, 5 and 6, there is shown an embodiment of a full range electrostatic loudspeaker in accordance with the invention. The basic components comprise an electrostatic transducer 10 (including a large flexible diaphragm 12 e.g. of metal coated mylar, and a pair of rigid planar high K electrodes 14, 16), a rigid-walled enclosure surrounding the transducer 10, an outlet passage, here in the form of a lens 20 and an amplifier 22.

The electrostatic transducer 10 extends across one third of the full width of the enclosure. The electrode assembly of the transducer has a height of ½ meter and a number of these are mounted above each other to achieve the required height.

The electrostatic transducer of this embodiment is of the balanced type in which the flexible diaphragm 12 is held in taut condition between two apertured electrodes 14, 16. The sound absorbent material 19 (effective down to about 300 Hz) and the rigid-walled enclosure prevent backward moving radiation emitted by diaphragm 12 back through electrode 14 from escaping and causing cancellation of the forward radiation.

The forward electrode 16 is disposed immediately adjacent the inlet 20i of the lens structure 20 (see FIG. 6). The lens is composed of a series of walls $\mathbf{20_1}$, $\mathbf{20_2}$,...$\mathbf{20_{19}}$ which are straight in the vertical direction (see FIG. 6) but are spaced apart and curved in accordance with a special pattern in the horizontal direction to define a series of channels, see FIG. 4a. Thus outer wall $\mathbf{20_1}$ and the next adjacent wall $\mathbf{20_2}$ define a channel (channel 1) having an inlet of width $W_1$ exposed to a corresponding outer portion of diaphragm 12 (through the apertures of the outer electrode 16). The walls $\mathbf{20_1}$ and $\mathbf{20_2}$ converge together and simultaneously curve toward the centerline of the lens, to the lens throat region $\mathbf{20_t}$.

Near this region the channels begin a re-entrant curve so that at the throat $\mathbf{20_t}$, the channel is again substantially perpendicular to the diaphragm, although displaced significantly toward the centerline. Beyond this region the walls $\mathbf{20_1}$ and $\mathbf{20_2}$ curve outwardly from the centerline and diverge from each other, terminating in ends 20*e* which, in this example, are disposed outside of the front wall of the enclosure. The axis $A_1$ of the outlet of channel 1 is thus directed outwardly at a substantial angle from its direction of the channel axis at the inlet. In like manner the other side of wall $\mathbf{20_2}$ and wall $\mathbf{20_3}$ define channel II. It is disposed to receive the sonic output of the next adjacent portion of the diaphragm. It curves and converges and diverges similarly to channel I while its output axis $A_2$ is disposed at a lesser angle to the normal to the diaphragm. Channel II provides the next adjacent segment of the solid angle A achieved by the lens. Channel III is likewise defined by the walls $\mathbf{20_3}$ and $\mathbf{20_4}$, and so on to Channel IX, along which extends the centerline. The lens structure is symmetrical about the centerline, and thus the right hand outer channel XVIII curves in like manner, but in opposite direction, to Channel I.

The outer portion of the walls $\mathbf{20_1}$–$\mathbf{20_{19}}$ are shaped to establish the series of outlet axes $A_1$–$A_{18}$, such that projections of these axes intersect at a common inward point C spaced substantially (e.g. ⅓ meter) from the diaphragm. Since a dispersal angle A of about one half a circle is desired, center C lies on the plane projected through the front surface of the enclosure. Preferably, as shown, the curvatures of the walls are arranged so that the sound path P along each of the channels and outwardly to a circle projected from the common center C of the outlets is the same length for all channels. Thus $P_1=P_2=P_3=...P_{17}=P_{18}$.

The effect of these features is to emit a circular wave front even though the sound emitting diaphragm is both planar and extremely directional for the high frequencies. The speaker retains the same circular horizontal cross-section throughout its height, hence the output sound wave is of cylindrical form, which can spread to fill a room with high frequency sound. The walls may be made of various conventional speaker material, e.g. paper stock of appropriate grade. The outer channels may be of lesser width than the inner channels (e.g. $W_1 < W_9$) taking advantage of the fact that the smaller the filament of sound, the more it can be bent without distortion. For outer channels especially, the channel width should be based upon the shortest audio wave length of interest and in general should be less than 3 centimeters. Practical limits exist, however, because too narrow a channel introduces too much resistance to the travel of the sound. Thus it is found that channel width on the order of 1.5 centimeters for the channels is suitable. A practical rule, for channels which turn significantly, is that the inlet width of the channel should approximate the wavelength of the highest frequency of interest.

In certain instances an alternative to the electrostatic speaker of FIGS. 4–6 can be employed according to the invention. As an example, referring to FIGS. 7 and 8, a large number of small electromagnet speakers 50, e.g. speakers having cone outlets of 5 centimeters width and height are stacked in vertical series to achieve an approximate floor-to-ceiling height. A lens 52 at all levels defines, in horizontal cross-sction, generally straight mid channels X and gradually curving outer channels Y diverging from the mid channels, for distributing the high frequency sound into the hemi-cylindrical wave form. Known techniques may be employed for assuring adequate low frequency emission of this speaker, as by increasing the driving power at the low frequencies by use of a filter having the inverse function to that of the response of the speaker and by suitable cabinet and suspension arrangements for effectively lowering the resonant frequency of the speaker system.

Such a speaker, too, can generate a hemi-cylindrical wave form, to produce uniform sound illumination at all frequencies from floor to ceiling and wall to wall to produce a high quality reproduction even in small rooms.

What is claimed is:

1. A stereophonic loudspeaker system for a room having an end wall and left and right side walls as viewed from a listener region, said system including left and right loudspeakers each comprising a cylindrical wave generator comprising an elongated sound transducer means emitting through a lens structure, said lens structure formed by a series of walls which are parallel to the axis of said generator and form a series of channels, said channels, in cross-section perpendicular to said axis, including substantially straight central channels and relatively curved outer channels which first converge toward each other to a constricted throat region and thereafter diverge to an outlet aperture, said generator capable of generating a uniform cylindrical sound wave that includes the entire audible frequency range, said cylindrical wave generator having an emitting arc for said uniform wave of at least 150°, said wave generator having a vertical axis and a sound emitting extent for said uniform wave approximating the floor to ceiling height of said room and said loudspeaker adapted for placement against a wall of said room in the manner that said wave is emitted away from said wall, to illuminate the room with said frequencies, said loudspeakers positioned along respective side walls, each spaced from the end wall, and said loudspeakers directed toward each other, the arc of radiation of each of said speakers including the listener region, the opposite side wall and the end wall, each of said speakers constructed and positioned to emit sound directly along a first path toward said listener region and along respective second and third paths; for said left speaker: said second path extending from said speaker to said end wall thence to the listener region and said third path extending from said speaker to said right side wall thence to the listener region; and for the said right speaker: said second path extending from said speaker to said end wall thence to said listener region and said third path extending from said speaker to said left wall thence to the listener region, said first, second and third paths differing in length from each other at least by the distance equivalent to the separate-source discrimination time.

2. The loudspeaker system of claim 1 wherein said loudspeakers are spaced at least about a meter from said end wall.

3. The loudspeaker system of claim 1 wherein said sound paths vary from each other in length by at least about 1 meter.

4. A primary production loudspeaker for use in a room of limited size such as a room of a home comprising a cylindrical wave generator comprising an elongated sound transducer means emitting through a lens structure, said lens structure formed by a series of walls which are parallel to the axis of said generator and form a series of channels, said channels, in cross-section perpendicular to said axis, including substantially straight central channels and relatively curved outer channels which first converge toward each other to a constricted throat region and thereafter diverge to an outlet aperture, said generator characterized by the capability of generating at its output aperture a cylindrical sound wave that includes essentially the entire audible frequency range and that has essentially uniform intensity for the length of the generator axis in planes through said axis, said wave generator being arranged vertically and having a sound emitting extent approximating the floor to ceiling height of said room, and said cylindrical wave generator having an emitting arc over the horizontal plane of at least 150°,the boundaries of said room cooperative with said wave generator to enable said cylindrical wave form to persist throughout the listener area with attenutation occurring in said area over said frequency range substantially on the basis of 1/R where R is the distance from the wave generator.

5. The loudspeaker of claim 4, having a back constructed for placement against a wall of said room and having said emitting aperture so directed into said room that said emitting arc of cylindrical wave emanates in substantially opposite directions horizontally along said wall.

6. The loudspeaker of claim 4 wherein said speaker extent includes the positions of ½ and 1 ¾ meters above the floor.

* * * * *